US006217624B1

(12) United States Patent
Morris et al.

(10) Patent No.: US 6,217,624 B1
(45) Date of Patent: Apr. 17, 2001

(54) FUEL COMPOSITIONS CONTAINING HYDROCARBYL-SUBSTITUTED POLYOXYALKYLENE AMINES

(75) Inventors: Jack Edward Morris, El Cerrito; Stephen M. Moore, Woodacre; Edward T. Sabourin, Novato, all of CA (US)

(73) Assignee: Chevron Chemical Company LLC, San Francisco, CA (US)

( * ) Notice: Subject to any disclaimer, the term of this patent is extended or adjusted under 35 U.S.C. 154(b) by 0 days.

(21) Appl. No.: 09/252,540

(22) Filed: Feb. 18, 1999

(51) Int. Cl.[7] ..... C10L 1/22; C10L 1/18
(52) U.S. Cl. ..... 44/434
(58) Field of Search ..... 44/433, 434

(56) References Cited

U.S. PATENT DOCUMENTS

| | | | | |
|---|---|---|---|---|
| 3,440,029 | | 4/1969 | Little et al. | 44/75 |
| 3,849,085 | | 11/1974 | Kreuz et al. | 44/78 |
| 4,191,537 | | 3/1980 | Lewis et al. | 44/71 |
| 4,247,301 | * | 1/1981 | Honnen | 44/433 |
| 4,270,930 | | 6/1981 | Campbell et al. | 44/71 |
| 4,332,595 | * | 6/1982 | Herbstman et al. | 44/433 |
| 4,568,358 | * | 2/1986 | Courtney | 44/433 |
| 4,881,945 | | 11/1989 | Buckley, III | 44/72 |
| 5,089,029 | * | 2/1992 | Hashimoto | 44/433 |
| 5,112,364 | | 5/1992 | Rath et al. | 44/418 |
| 5,660,601 | * | 8/1997 | Oppenlander | 44/433 |
| 5,752,991 | | 5/1998 | Plavac | 44/424 |

* cited by examiner

*Primary Examiner*—Margaret Medley
*Assistant Examiner*—Cephia D. Toomer
(74) *Attorney, Agent, or Firm*—Claude J. Caroli

(57) ABSTRACT

A fuel composition comprising a major amount of hydrocarbons boiling in the gasoline or diesel range and about 2,050 to about 10,000 parts per million by weight of a hydrocarbyl-substituted polyoxyalkylene amine having the formula:

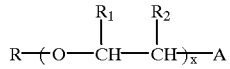

or a fuel-soluble salt thereof;

wherein R is a hydrocarbyl group having from about 1 to about 30 carbon atoms;

$R_1$ and $R_2$ are each independently hydrogen or lower alkyl having about 1 to about 6 carbon atoms and each $R_1$ and $R_2$ is independently selected in each —O—$CHR_1$—$CHR_2$— unit;

A is amino, N-alkyl amino having about 1 to about 20 carbon atoms in the alkyl group, N,N-dialkyl amino having about 1 to about 20 carbon atoms in each alkyl group, or a polyamine moiety having about 2 to about 12 amine nitrogen atoms and about 2 to about 40 carbon atoms; and x is an integer from about 5 to about 100.

The fuel compositions of the present invention are useful for the prevention and control of engine deposits, particularly combustion chamber deposits.

37 Claims, No Drawings

FUEL COMPOSITIONS CONTAINING HYDROCARBYL-SUBSTITUTED POLYOXYALKYLENE AMINES

BACKGROUND OF THE INVENTION

1. Field of the Invention

This invention relates to the use of hydrocarbyl-substituted polyoxyalkylene amines in fuel compositions to prevent and control engine deposits.

2. Description of the Related Art

It is well known that automobile engines tend to form deposits on the surface of engine components, such as carburetor ports, throttle bodies, fuel injectors, intake ports, intake valves, and combustion chambers, due to the oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants. Therefore, the development of effective fuel detergents or "deposit control" additives to prevent or control such deposits is of considerable importance and numerous such materials are known in the art.

For example, aliphatic hydrocarbon-substituted phenols are known to reduce engine deposits when used in fuel compositions. U.S. Pat. No. 3,849,085, issued Nov. 19, 1974 to Kreuz et al., discloses a motor fuel composition comprising a mixture of hydrocarbons in the gasoline boiling range containing about 0.01 to about 0.25 volume percent of a high molecular weight aliphatic hydrocarbon-substituted phenol in which the aliphatic hydrocarbon radical has an average molecular weight in the range of about 500 to about 3,500. This patent teaches that gasoline compositions containing minor amounts of an aliphatic hydrocarbon-substituted phenol not only prevent or inhibit the formation of intake valve and port deposits in a gasoline engine, but also enhance the performance of the fuel composition in engines designed to operate at higher operating temperatures with a minimum of decomposition and deposit formation in the manifold of the engine.

Polyether amine fuel additives are also well known in the art for the prevention and control of engine deposits. These polyether additives have a polyoxyalkylene "backbone", i.e., the polyether portion of the molecule consists of repeating oxyalkylene units. U.S. Pat. No. 4,191,537, issued Mar. 4, 1980 to Lewis et al., for example, discloses a fuel composition comprising a major portion of hydrocarbons boiling in the gasoline range and from 30 to 2,000 ppm of a hydrocarbyl polyoxyalkylene aminocarbamate having a molecular weight from about 600 to 10,000, and at least one basic nitrogen atom. The hydrocarbyl polyoxyalkylene moiety is composed of oxyalkylene units having from 2 to 5 carbon atoms in each oxyalkylene unit. These fuel compositions are taught to maintain the cleanliness of intake systems without contributing to combustion chamber deposits.

Aromatic compounds containing a poly(oxyalkylene) moiety are also known in the art. For example, the above-mentioned U.S. Pat. No. 4,191,537, discloses alkylphenyl poly(oxyalkylene) polymers which are useful as intermediates in the preparation of alkylphenyl poly(oxyalkylene) aminocarbamates.

Similarly, U.S. Pat. No. 4,881,945, issued Nov. 21, 1989 to Buckley, discloses a fuel composition comprising a hydrocarbon boiling in the gasoline or diesel range and from about 30 to about 5,000 parts per million of a fuel soluble alkylphenyl polyoxyalkylene aminocarbamate having at least one basic nitrogen and an average molecular weight of about 800 to 6,000 and wherein the alkyl group contains at least 40 carbon atoms.

Also, U.S. Pat. No. 4,270,930, issued Jun. 2, 1981 to Campbell et al., discloses a fuel composition comprising a major amount of hydrocarbons boiling in the gasoline range and from 0.3 to 3 weight percent of a hydrocarbyl poly (oxyalkylene) aminocarbamate of molecular weight from about 600 to about 10,000 having at least one basic nitrogen atom, wherein the hydrocarbyl group contains from 1 to 30 carbon atoms.

U.S. Pat. No. 5,112,364, issued May 12, 1992 to Rath et al., discloses gasoline-engine fuels which contain from 10 to 2,000 parts per million by weight of a polyetheramine and/or a polyetheramine derivative, wherein the polyetheramine is prepared by reductive amination of a phenol-initiated or alkylphenol-initiated polyether alcohol with ammonia or a primary amine.

U.S. Pat. No. 5,660,601, issued Aug. 26, 1997 to Oppenlander et al., discloses fuels for gasoline engines containing from 10 to 2,000 mg per kg of fuel (i.e., 10 to 2,000 parts per million) of an alkyl-terminated polyetheramine, therein the alkyl group contains from 2 to 30 carbon atoms and the polyether moiety contains from 12 to 28 butylene oxide units. This patent further teaches that the polyetheramines are prepared by the reaction of an alcohol with butylene oxide, and subsequent amination with ammonia or an amine.

U.S. Pat. No. 4,332,595, issued Jun. 1, 1982 to Herbstman et al., discloses a gasoline detergent additive which is a hydrocarbyl-substituted polyoxypropylene diamine, wherein the hydrocarbyl substituent contains 8 to 18 carbon atoms. This patent further teaches that the additive is prepared by reductive amination of a hydrocarbyl-substituted polyoxypropylene alcohol with ammonia to give a polyoxypropylene amine, which is subsequently reacted with acrylonitrile to give the corresponding N-2-cyanoethyl derivative. Hydrogenation in the presence of ammonia then provides the desired hydrocarbyl-substituted polyoxypropylene N-3-aminopropyl amine.

U.S. Pat. No. 3,440,029, issued Apr. 22, 1969 to Little et al., discloses a gasoline anti-icing additive which is a hydrocarbyl-substituted polyoxyalkylene amine, wherein the hydrocarbyl substituent contains 8 to 24 carbon atoms. This patent teaches that the additive may be prepared by known processes wherein a hydroxy compound is condensed with an alkylene oxide or mixture of alkylene oxides and then the terminal amino group is attached by either reductive amination or by cyanoethylation followed by hydrogenation. Alternatively, the hydroxy compound or oxyalkylated derivative thereof may be reacted with bis(2-chloroethyl)ether and alkali to make a chlorine-terminated compound, which is then reacted with ammonia to produce the amine-terminated final product.

U.S. Pat. No. 4,247,301, issued Jan. 27, 1981 to Honnen, discloses hydrocarbyl-substituted poly(oxyalkylene) polyamines, wherein the hydrocarbyl group contains from 1 to 30 carbon atoms and the polyamine moiety contains from 2 to 12 amine nitrogen atoms and from 2 to 40 carbon atoms. This patent teaches that the additives may be prepared by the reaction of a suitable hydrocarbyl-terminated polyether alcohol with a halogenating agent such as HCl, thionyl chloride, or epichlorohydrin to form a polyether chloride, followed by reaction of the polyether chloride with a polyamine to form the desired poly(oxyalkylene) polyamine. This patent also teaches at Example 6 that the polyether chloride may be reacted with ammonia or dimethylamine to form the corresponding polyether amine or polyether dimethylamine.

U.S. Pat. No. 5,752,991 issued May 19, 1998 to Plavac, discloses fuel compositions containing from about 50 to about 2,500 parts per million by weight of a long chain alkylphenyl polyoxyalkylene amine, wherein the alkyl substituent on the phenyl ring has at least 40 carbon atoms.

SUMMARY OF THE INVENTION

It has now been discovered that certain hydrocarbyl-substituted polyoxyalkylene amines provide excellent control of engine deposits, especially combustion chamber deposits, when employed in high concentrations in fuel compositions.

Accordingly, the present invention provides a novel fuel composition comprising a major amount of hydrocarbons boiling in the gasoline or diesel range and about 2050 to about 10,000 parts per million by weight of a compound of the formula:

(I)

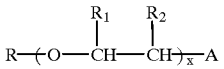

or a fuel-soluble salt thereof;

wherein R is a hydrocarbyl group having from about 1 to about 30 carbon atoms;

$R_1$ and $R_2$ are each independently hydrogen or lower alkyl having from about 1 to about 6 carbon atoms and each $R_1$ and $R_2$ is independently selected in each —O—$CHR_1$—$CHR_2$— unit;

A is amino, N-alkyl amino having about 1 to about 20 carbon atoms in the alkyl group, N,N-dialkyl amino having about 1 to about 20 carbon atoms in each alkyl group, or a polyamine moiety having about 2 to about 12 amine nitrogen atoms and about 2 to about 40 carbon atoms; and x is an integer from about 5 to about 100.

Among other factors, the present invention is based on the surprising discovery that fuel compositions containing high concentrations of certain hydrocarbyl-substituted polyoxyalkylene amines provide excellent control of engine deposits, especially combustion chamber deposits.

DETAILED DESCRIPTION OF THE INVENTION

The hydrocarbyl-substituted polyoxyalkylene amines employed in the present invention have the general formula:

(I)

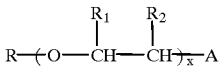

wherein R, $R_1$, $R_2$, A, and x are as defined above.

In Formula I, above, R is a hydrocarbyl group having from about 1 to about 30 carbon atoms. Preferably, R is an alkyl or alkylphenyl group. More preferably, R is an alkylphenyl group, wherein the alkyl moiety is a straight or branched chain alkyl of from about 1 to about 24 carbon atoms.

Preferably, one of $R_1$ and $R_2$ is lower alkyl of 1 to 4 carbon atoms, and the other is hydrogen. More preferably, one of $R_1$ and $R_2$ is methyl or ethyl, and the other is hydrogen.

In general, A is amino, N-alkyl amino having from about 1 to about 20 carbon atoms in the alkyl group, preferably about 1 to about 6 carbon atoms, more preferably about 1 to about 4 carbon atoms; N,N-dialkyl amino having from about 1 to about 20 carbon atoms in each alkyl group, preferably about 1 to about 6 carbon atoms, more preferably about 1 to about 4 carbon atoms; or a polyamine moiety having from about 2 to about 12 amine nitrogen atoms and from about 2 to about 40 carbon atoms, preferably about 2 to 12 amine nitrogen atoms and about 2 to 24 carbon atoms. More preferably, A is amino or a polyamine moiety derived from a polyalkylene polyamine, including alkylene diamine. Most preferably, A is amino or a polyamine moiety derived from ethylene diamine or diethylene triamine.

Preferably, x is an integer from about 5 to about 50, more preferably from about 8 to about 30, and most preferably from about 10 to about 25.

The compounds of the present invention will generally have a sufficient molecular weight so as to be non-volatile at normal engine intake valve operating temperatures (about 200–250° C.). Typically, the molecular weight of the compounds of this invention will range from about 600 to about 10,000.

Fuel-soluble salts of the compounds of formula I can be readily prepared for those compounds containing an amino or substituted amino group and such salts are contemplated to be useful for preventing or controlling engine deposits. Suitable salts include, for example, those obtained by protonating the amino moiety with a strong organic acid, such as an alkyl- or arylsulfonic acid. Preferred salts are derived from toluenesulfonic acid and methanesulfonic acid

Definitions

As used herein, the following terms have the following meanings unless expressly stated to the contrary.

The term "amino" refers to the group: —$NH_2$.

The term "N-alkylamino" refers to the group: —$NHR_a$ wherein $R_a$ is an alkyl group. The term "N,N-dialkylamino" refers to the group: —$NR_bR_c$, wherein $R_b$ and $R_c$ are alkyl groups.

The term "hydrocarbyl" refers to an organic radical primarily composed of carbon and hydrogen which may be aliphatic, alicyclic, aromatic or combinations thereof, e.g., aralkyl or alkaryl. Such hydrocarbyl groups are generally free of aliphatic unsaturation, i.e., olefinic or acetylenic unsaturation, but may contain minor amounts of heteroatoms, such as oxygen or nitrogen, or halogens, such as chlorine.

The term "alkyl" refers to both straight- and branched-chain alkyl groups.

The term "lower alkyl" refers to alkyl groups having 1 to about 6 carbon atoms and includes primary, secondary, and tertiary alkyl groups. Typical lower alkyl groups include, for example, methyl, ethyl, n-propyl, isopropyl, n-butyl, sec-butyl, t-butyl, n-pentyl, n-hexyl, and the like.

The term "alkylene" refers to straight- and branched-chain alkylene groups having at least 2 carbon atoms. Typical alkylene groups include, for example, ethylene (—$CH_2CH_2$—), propylene (—$CH_2CH_2CH_2$—), isopropylene (—$CH(CH_3)CH_2$—), n-butylene (—$CH_2CH_2CH_2CH_2$—), sec-butylene (—$CH(CH_2CH_3)CH_2$—), n-pentylene (—$CH_2CH_2CH_2CH_2CH_2$—), and the like.

The term "polyoxyalkylene" refers to a polymer or oligomer having the general formula:

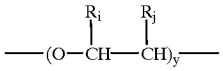

wherein $R_i$ and $R_j$ are each independently hydrogen or lower alkyl groups, and y is an integer from about 5 to about 100. When referring herein to the number of oxyalkylene units in a particular polyoxyalkylene compound, it is to be understood that this number refers to the average number of oxyalkylene units in such compounds unless expressly stated to the contrary.

General Synthetic Procedures

The hydrocarbyl-substituted polyoxyalkylene amines employed in this invention may be prepared by the following general methods and procedures. It should be appreciated that where typical or preferred process conditions (e.g., reaction temperatures, times, mole ratios of reactants, solvents, pressures, etc.) are given, other process conditions may also be used unless otherwise stated. Optimum reaction conditions may vary with the particular reactants or solvents used, but such conditions can be determined by one skilled in the art by routine optimization procedures.

The hydrocarbyl-substituted polyoxyalkylene amines employed in the present invention contain (a) a hydrocarbyl-substituted polyoxyalkylene component, and (b) an amine component.

A. The Hydrocarbyl-Substituted Polyoxyalkylene Component

The hydrocarbyl-substituted polyoxyalkylene polymers which are utilized in preparing the hydrocarbyl-substituted polyoxyalkylene amines employed in the present invention are monohydroxy compounds, i.e., alcohols, often termed hydrocarbyl "capped" polyoxyalkylene glycols and are to be distinguished from the polyoxyalkylene glycols (diols), which are not hydrocarbyl terminated, i.e., not capped. The hydrocarbyl-substituted polyoxyalkylene alcohols are produced by the addition of lower alkylene oxides, such as ethylene oxide, propylene oxide, or the butylene oxides, to the hydroxy compound, ROH, under polymerization conditions, wherein R is the hydrocarbyl group, as defined above, which caps the polyoxyalkylene chain. Preferred polyoxyalkylene polymers are those derived from $C_3$ to $C_4$ oxyalkylene units. Methods of production and properties of these polymers are disclosed in U.S. Pat. Nos. 2,841,479 and 2,782,240 and Kirk-Othmer's "*Encyclopedia of Chemical Technology*", Volume 19, page 507. In the polymerization reaction, a single type of alkylene oxide may be employed, e.g., propylene oxide, in which case the product is a homopolymer, e.g., a polyoxypropylene alcohol. However, copolymers are equally satisfactory and random copolymers are readily prepared by contacting the hydroxy-containing compound with a mixture of alkylene oxides, such as a mixture of propylene and butylene oxides. Block copolymers of oxyalkylene units also provide satisfactory polyoxyalkylene units for the practice of the present invention.

The amount of alkylene oxide employed in this reaction will generally depend on the number of oxyalkylene units desired in the product. Typically, the molar ratio of alkylene oxide to hydroxy-containing compound will range from about 5:1 to about 100:1; preferably, from about 5:1 to about 50:1, more preferably from about 8:1 to about 30:1.

Alkylene oxides suitable for use in this polymerization reaction include, for example, ethylene oxide; propylene oxide; and butylene oxides, such as 1,2-butylene oxide (1,2-epoxybutane) and 2,3-butylene oxide (2,3-epoxybutane). Preferred alkylene oxides are propylene oxide and 1,2-butylene oxide, both individually and in mixtures thereof The hydrocarbyl moiety, R, which terminates the polyoxyalkylene chain will generally contain from about 1 to about 30 carbon atoms, preferably from about 2 to about 20 carbon atoms, and more preferably from about 4 to about 18 carbon atoms, and is generally derived from the monohydroxy compound, ROH, which is the initial site of the alkylene oxide addition in the polymerization reaction. Such monohydroxy compounds are preferably aliphatic or aromatic alcohols having from about 1 to about 30 carbon atoms, more preferably and alkanol or an alkylphenol, and most preferably an alkyphenol wherein the alkyl substituent is a straight or branched chain alkyl of from about 1 to about 24 carbon atoms. Preferred alkylphenols include those wherein the alkyl substituent contains from about 4 to about 16 carbon atoms. An especially preferred alkylphenol is one wherein the alkyl group is obtained by polymerizing propylene to an average of 4 propylene units, that is, about 12 carbon atoms, having the common name of propylene tetramer. The resulting alkylphenol is commonly called tetrapropenylphenol or, more generically, dodecylphenol. Preferred alkylphenol-initiated polyoxyalkylene compounds may be termed either alkylphenylpolyoxyalkylene alcohols or polyalkoxylated alkylphenols.

B. The Amine Component

As indicated above, the hydrocarbyl-substituted polyoxyalkylene amines employed in the present invention contain an amine component.

In general, the amine component will contain an average of at least about one basic nitrogen atom per molecule. A "basic nitrogen atom" is one that is titratable by a strong acid, for example, a primary, secondary, or tertiary amine nitrogen; as distinguished from, for example, an carbamyl nitrogen, e.g., —OC(O)NH—, which is not titratable with a strong acid. Preferably, at least one of the basic nitrogen atoms of the amine component will be primary or secondary amine nitrogen, more preferably at least one will be a primary amine nitrogen.

The amine component of the hydrocarbyl-substituted polyoxyalkylene amines employed in this invention is preferably derived from ammonia, a primary alkyl or secondary dialkyl monoamine, or a polyamine having a terminal amino nitrogen atom.

Primary alkyl monoamines useful in preparing compounds of the present invention contain 1 nitrogen atom and from about 1 to about 20 carbon atoms, more preferably about 1 to 6 carbon atoms, most preferably 1 to 4 carbon atoms. Examples of suitable monoamines include N-methylamine, N-ethylamine, N-n-propylamine, N-isopropylamine, N-n-butylamine, N-isobutylamine, N-sec-butylamine, N-tert-butylamine, N-n-pentylamine, N-cyclopentylamine, N-n-hexylamine, N-cyclohexylamine, N-octylamine, N-decylamine, N-dodecylamine, N-octadecylamine, N-benzylamine, N-(2-phenylethyl) amine, 2-aminoethanol, 3-amino-1-propanol, 2-(2-aminoethoxy)ethanol, N-(2-methoxyethyl)amine, N-(2-ethoxyethyl)amine and the like. Preferred primary amines are N-methylamine, N-ethylamine and N-n-propylamine.

The amine component of the presently employed fuel additive may also be derived from a secondary dialkyl monoamine. The alkyl groups of the secondary amine may be the same or different and will generally each contain about 1 to about 20 carbon atoms, more preferably about 1 to about 6 carbon atoms, most preferably about 1 to about 4 carbon atoms. One or both of the alkyl groups may also contain one or more oxygen atoms.

Preferably, the alkyl groups of the secondary amine are independently selected from the group consisting of methyl, ethyl, propyl, butyl, pentyl, hexyl, 2-hydroxyethyl and 2-methoxyethyl. More preferably, the alkyl groups are methyl, ethyl or propyl.

Typical secondary amines which may be used in this invention include N,N-dimethylamine, N,N-diethylamine, N,N-di-n-propylamine, N,N-diisopropylamine, N,N-di-n-butylamine, N,N-di-sec-butylamine, N,N-di-n-pentylamine, N,N-di-n-hexylamine, N,N-dicyclohexylamine, N,N-dioctylamine, N-ethyl-N-methylamine, N-methyl-N-n-propylamine, N-n-butyl-N-methylamine, N-methyl-N-octylamine, N-ethyl-N-isopropylamine, N-ethyl-N-octylamine, N,N-di(2-hydroxyethyl)amine, N,N-di(3-hydroxypropyl)amine, N,N-di(ethoxyethyl)amine, N,N-di (propoxyethyl)amine and the like. Preferred secondary amines are N,N-dimethylamine, N,N-diethylamine and N,N-di-n-propylamine.

Cyclic secondary amines may also be used to form the additives employed in this invention. In such cyclic compounds, the alkyl groups, when taken together, form one or more 5- or 6-membered rings containing up to about 20 carbon atoms. The ring containing the amine nitrogen atom is generally saturated, but may be fused to one or more saturated or unsaturated rings. The rings may be substituted with hydrocarbyl groups of from 1 to about 10 carbon atoms and may contain one or more oxygen atoms.

Suitable cyclic secondary amines include piperidine, 4methylpiperidine, pyrrolidine, morpholine, 2,6-dimethylmorpholine and the like.

Suitable polyamines can have a straight- or branched-chain structure and may be cyclic or acyclic or combinations thereof. Generally, the amine nitrogen atoms of such polyamines will be separated from one another by at least two carbon atoms, i.e., polyamines having an aminal structure are not suitable. The polyamine may also contain one or more oxygen atoms, typically present as an ether or a hydroxyl group. Polyamines having a carbon-to-nitrogen ratio of from about 1:1 to about 10:1 are particularly preferred.

In preparing the compounds employed in this invention using a polyamine where the various nitrogen atoms of the polyamine are not geometrically equivalent, several substitutional isomers are possible and each of these possible isomers is encompassed within this invention.

A particularly preferred group of polyamines for use in the present invention are polyalkylene polyamines, including alkylene diamines. Such polyalkylene polyamines will typically contain from about 2 to about 12 nitrogen atoms and from about 2 to about 40 carbon atoms, preferably about 2 to about 24 carbon atoms. Preferably, the alkylene groups of such polyalkylene polyamines will contain from about 2 to about 6 carbon atoms, more preferably from about 2 to about 4 carbon atoms.

Examples of suitable polyalkylene polyamines include ethylenediamine, propylenediamine, isopropylenediamine, butylenediamine, pentylenediamine, hexylenediamine, diethylenetriamine, dipropylenetriamine, dimethylaminopropylamine, diisopropylenetriamine, dibutylenetriamine, di-sec-butylenetriamine, triethylenetetraamine, tripropylenetetramine, triisobutylenetetraamine, tetraethylenepentamine, pentaethylenehexamine, dimethylaminopropylamine, and mixtures thereof.

Particularly suitable polyalkylene polyamines are those having the formula:

$$H_2N—(R_3—NH)_z—H$$

wherein $R_3$ is a straight- or branched-chain alkylene group having from about 2 to about 6 carbon atoms, preferably from about 2 to about 4 carbon atoms, most preferably about 2 carbon atoms, i.e., ethylene (—$CH_2CH_2$—); and z is an integer from about 1 to about 4, preferably about 1 or about 2.

Particularly preferred polyalkylene polyamines are ethylenediamine, diethylenetriamine, triethylenetetraamine, and tetraethylenepentamine. Most preferred are ethylenediamine and diethylenetriamine, especially ethylenediamine.

Also contemplated for use in the present invention are cyclic polyamines having one or more 5- to 6-membered rings. Such cyclic polyamines compounds include piperazine, 2-methylpiperazine, N-(2-aminoethyl) piperazine, N-2-hydroxyethyl)piperazine, 1,2-bis-(N-piperazinyl)ethane, 3-aminopyrrolidine, N-(2-aminoethyl) pyrrolidine, and the like. Among the cyclic polyamines, the piperazines are preferred.

Many of the polyamines suitable for use in the present invention are commercially available and others may be prepared by methods which are well known in the art. For example, methods for preparing amines and their reactions are detailed in Sidgewick's "*The Organic Chemistry of Nitrogen*", Clarendon Press, Oxford, 1966; Noller's "*Chemistry of Organic Compounds*", Saunders, Philadelphia, 2nd Ed., 1957; and Kirk-Othmer's "*Encyclopedia of Chemical Technology*", 2nd Ed., especially Volume 2, pp. 99–116.

C. Preparation of the Hydrocarbyl-Substituted Polyoxyalkylene Amine

The additives employed in this invention may be conveniently prepared by reacting a hydrocarbyl-substituted polyoxyalkylene alcohol, either directly or through an intermediate, with a nitrogen-containing compound, such as ammonia, a primary or secondary alkyl monoamine or a polyamine, as described herein.

The hydrocarbyl-substituted polyoxyalkylene alcohols used to form the polyoxyalkylene amines employed in the present invention are typically known compounds that can be prepared using conventional procedures. Suitable procedures for preparing such compounds are taught, for example, in U.S. Pat. Nos. 2,782,240 and 2,841,479, as well as U.S. Pat. No. 4,881,945, the disclosures of which are incorporated herein by reference.

Preferably, the polyoxyalkylene alcohols are prepared by contacting an alkoxide or phenoxide metal salt with from about 5 to about 100 molar equivalents of an alkylene oxide, such as propylene oxide or butylene oxide, or mixtures of alkylene oxides.

Typically, the alkoxide or phenoxide metal salt is prepared by contacting the corresponding hydroxy compound with a strong base, such as sodium hydride, potassium hydride, sodium amide, and the like, in an inert solvent, such as toluene, xylene, and the like, under substantially anhydrous conditions at a temperature in the range from about −10° C. to about 120° C. for from about 0.25 to about 3 hours.

The alkoxide or phenoxide metal salt is generally not isolated, but is reacted in situ with the alkylene oxide or mixture of alkylene oxides to provide, after neutralization, the polyoxyalkylene alcohol. This polymerization reaction is typically conducted in a substantially anhydrous inert solvent at a temperature of from about 30° C. to about 150° C. for from about 2 to about 120 hours. Suitable solvents for this reaction, include toluene, xylene, and the like. Typically, the reaction is conducted at a pressure sufficient to contain the reactants and the solvent, preferably at-atmospheric or ambient pressure.

The hydrocarbyl-substituted polyoxyalkylene alcohol may then be converted to the desired polyoxyalkylene amine by a variety of procedures known in the art.

For example, the terminal hydroxy group on the hydrocarbyl-substituted polyoxyalkylene alcohol may first be converted to a suitable leaving group, such as a mesylate, chloride or bromide, and the like, by reaction with a suitable reagent, such as methanesulfonyl chloride. The resulting polyoxyalkylene mesylate or equivalent intermediate may then be converted to a phthalimide derivative by reaction with potassium phthalimide in the presence of a suitable solvent, such as N,N-dimethylformamide. The polyoxyalkylene phthalimide derivative is subsequently converted to the desired hydrocarbyl-substituted polyoxyalkylene amine by reaction with a suitable amine, such as hydrazine.

The polyoxyalkylene alcohol may also be converted to the corresponding polyoxyalkylene chloride by reaction with a suitable halogenating agent, such as HCl, thionyl chloride, or epichlorohydrin, followed by displacement of the chloride with a suitable amine, such as ammonia, a primary or secondary alkyl monoamine, or a polyamine, as described, for example, in U.S. Pat. No. 4,247,301 to Honnen, the disclosure of which is incorporated herein by reference.

Alternatively, the hydrocarbyl-substituted polyoxyalkylene amines employed in the present invention may be prepared from the corresponding polyoxyalkylene alcohol by a process commonly referred to as reductive amination, such as described in U.S. Pat. No. 5,112,364 to Rath et al. and U.S. Pat. No. 4,332,595 to Herbstman et al., the disclosures of which are incorporated herein by reference.

In the reductive amination procedure, the hydrocarbyl-substituted polyoxyalkylene alcohol is aminated with an appropriate amine, such as ammonia or a primary alkyl monoamine, in the presence of hydrogen and a hydrogenation-dehydrogenation catalyst. The amination reaction is typically carried out at temperatures in the range of about 160° C. to about 250° C. and pressures of about 1,000 to about 5,000 psig, preferably about 1,500 to about 3,000 psig. Suitable hydrogenation-dehydrogenation catalysts include those containing platinum, palladium, cobalt, nickel, copper, or chromium, or mixtures thereof. Generally, an excess of the ammonia or amine reactant is used, such as about a 5-fold to about 60-fold molar excess, and preferably about a 10-fold to about 40-fold molar excess, of ammonia or amine.

When the reductive amination is carried out with a polyamine reactant, the amination is preferably conducted using a two-step procedure as described in European Patent Application Publication No. EP 0,781,793, published Jul. 2, 1997, the disclosure of which is incorporated herein by reference in its entirety. According to this procedure, a polyoxyalkylene alcohol is first contacted with a hydrogenation-dehydrogenation catalyst at a temperature of at least 230° C. to provide a polymeric carbonyl intermediate, which is subsequently reacted with a polyamine at a temperature below about 190° C. in the presence of hydrogen and a hydrogenation catalyst to produce the polyoxyalkylene polyamine adduct.

The hydrocarbyl-substituted polyoxyalkylene amines obtained by amination can be added as such to hydrocarbon fuels.

Fuel Compositions

The hydrocarbyl-substituted polyoxyalkylene amines employed in the present invention are useful as additives in hydrocarbon fuels to prevent and control engine deposits, particularly combustion chamber deposits. Typically, the desired deposit control will be achieved by operating an internal combustion engine with a fuel composition containing the hydrocarbyl-substituted polyoxyalkylene amine. The proper concentration of additive necessary to achieve the desired deposit control varies depending upon the type of fuel employed, the type of engine, operating conditions, and the presence of other fuel additives.

In general, the concentration of the hydrocarbyl-substituted polyoxyalkylene amines employed in this invention in hydrocarbon fuel will range from about 2,050 to about 10,000 parts per million (ppm) by weight, preferably from about 2,050 to about 5,000 ppm, more preferably from about 2,050 to about 4,000 ppm, and even more preferably from about 2,600 to about 3,500 ppm.

The hydrocarbyl-substituted polyoxyalkylene amines employed in the present invention may be formulated as a concentrate using an inert stable oleophilic (i.e., dissolves in gasoline) organic solvent boiling in the range of from about 150° F. to about 400° F. (from about 65° C. to about 205° C). Preferably, an aliphatic or an aromatic hydrocarbon solvent is used, such as benzene, toluene, xylene, or higher-boiling aromatics or aromatic thinners. Aliphatic alcohols containing from about 3 to about 8 carbon atoms, such-as isopropanol, isobutylcaxbinol, n-butanol, and the like, in combination with hydrocarbon solvents are also suitable for use with the present additives. In the concentrate, the amount of the additive will generally range from about 10 to below about 100 weight percent, preferably from about 20 to below about 100 weight percent, more preferably from about 40 to below about 100 weight percent. Alternatively, the hydrocarbyl-substituted polyoxyalkylene amine may be employed neat, that is, without a solvent.

In gasoline fuels, other fuel additives may be employed with the additives of the present invention, including, for example, oxygenates, such as t-butyl methyl ether, anti-knock agents, such as methylcyclopentadienyl manganese tricarbonyl, and other dispersants/detergents, such as hydrocarbyl amines, Mannich reaction products, or succinimides. Additionally, antioxidants, metal deactivators, and demulsifiers may be present.

In diesel fuels, other well-known additives can be employed, such as pour point depressants, flow improvers, cetane improvers, and the like.

A fuel-soluble, nonvolatile carrier fluid or oil may also be used with the hydrocarbyl-substituted polyoxyalkylene amines employed in this invention. The carrier fluid is a chemically inert hydrocarbon-soluble liquid vehicle which substantially increases the nonvolatile residue (NVR) or solvent-free liquid fraction of the fuel additive composition while not overwhelmingly contributing to octane requirement increase. The carrier fluid may be a natural or synthetic fluid, such as mineral oil, refined petroleum oils, synthetic polyalkanes and alkenes, including hydrogenated and unhydrogenated polyalphaolefins, and synthetic polyoxyalkylene-derived fluids, such as those described, for example, in U.S. Pat. No. 4,191,537 to Lewis and polyesters, such as those described, for example, in U.S. Pat. Nos.

3,756,793 and 5,004,478, and in European Patent Application Nos. 356,726 and 382,159.

These carrier fluids are believed to act as a carrier for the fuel additives of the present invention and to assist in removing and retarding certain deposits. The carrier fluid may also exhibit synergistic deposit control properties when used in combination with the hydrocarbyl-substituted poly-oxyalkylene amines of this invention.

The carrier fluids may be employed in amounts ranging from about 50 to about 5,000 ppm by weight of the hydrocarbon fuel, preferably from about 400 to about 3,000 ppm of the fuel. Preferably, the ratio of carrier fluid to deposit control additive will range from about 0.01:1 to about 10:1, more preferably from about 0.1:1 to about 5:1.

When employed in a fuel concentrate, carrier fluids will generally be present in amounts ranging from about 1 to about 70 weight percent, preferably from about 5 to about 40 weight percent.

EXAMPLES

The following examples are presented to illustrate specific embodiments of the present invention and synthetic preparations thereof and should not be interpreted as limitations upon the scope of the invention.

Example 1

Preparation of Dodecylphenoxy Poly(oxybutylene)poly(oxypropylene) Amine

A dodecylphenoxypoly(oxybutylene)poly(oxypropylene) amine was prepared by the reductive amination with ammonia of the random copolymer poly(oxyalkylene) alcohol, dodecylphenoxy poly(oxybutylene)poly(oxypropylene) alcohol, wherein the alcohol has an average molecular weight of about 1598. The poly(oxyalkylene) alcohol was prepared from dodecylphenol using a 75/25 weight/weight ratio of butylene oxide and propylene oxide, in accordance with the procedures described in U.S. Pat. Nos. 4,191,537; 2,782,240 and 2,841,479, as well as in Kirk-Othmer, "Encyclopedia of Chemical Technology", 4th edition, Volume 19, 1996, page 722. The reductive amination of the poly (oxyalkylene) alcohol was carried out using conventional techniques as described in U.S. Pat. Nos. 5,112,364; 4,609, 377 and 3,440,029.

Example 2

Preparation of Dodecylphenoxy Poly(oxybutylene) Amine

A dodecylphenoxypoly(oxybutylene) amine was prepared by the reductive amination with ammonia of a dodecylphenoxy poly(oxybutylene) alcohol having an average molecular weight of about 1600. The dodecylphenoxy poly (oxybutylene) alcohol was prepared from dodecylphenol and butylene oxide, in accordance with the procedures descried in U.S. Pat. Nos. 4,191,537; 2,782,240 and 2,841, 479, as well as in Kirk-Othmer, "Encyclopedia of Chemical Technology", 4th edition, Volume 19, 1996, page 722. The reductive amination of the dodecylphenoxy poly (oxybutylene) alcohol was carried out using conventional techniques as described in U.S. Pat. Nos. 5,112,364; 4,609, 377 and 3,440,029.

Example 3

Single Cylinder Engine Test

The fuel composition of the present invention was tested in a laboratory single cylinder engine to evaluate its intake valve and combustion chamber deposit control performance. The test engine was a Labeco CLR single-cylinder laboratory test engine. The major engine dimensions are set forth in Table I.

TABLE I

| Engine Dimensions | |
|---|---|
| Bore | 3.801 inches |
| Stroke | 3.745 inches |
| Displacement Volume | 42.5 cubic inches |
| Compression Ratio | 8:1 |

The test engine was operated for 80 hours (24 hours a day) on a controlled load and speed schedule. The coolant temperature was controlled to 194° F. (90° C.). Manifold vacuum was controlled and is inversely proportional to the load being generated by the engine. The details of the test cycle are set forth in Table II.

TABLE II

| Engine Operating Cycle | | | |
|---|---|---|---|
| Step | Cycle Step Duration (minutes) | Engine Speed [RPM] | Engine Manifold Vacuum [inches Hg] |
| 1 | 2 | 2,000 | 6 |
| 2 | 1 | Idle | Idle |
| 3 | 2 | 2,000 | 6 |
| 4 | 2 | 1,800 | 6 |
| 5 | 1 | 2,500 | 4 |
| 6 | 2 | 2,000 | 6 |
| 7 | 2 | Idle | Idle |
| 8 | 1 | 2,000 | 6 |
| 9 | 1 | 1,800 | 4 |
| 10 | 5 | 2,500 | 3 |
| 11 | 2 | 1,500 | 8 |
| 12 | 1 | 1,800 | 8 |
| 13 | 2 | 2,200 | 8 |
| Repeat to Step 1 | | | |

All of the test runs were made with the same base gasoline, which was representative of commercial unleaded fuel. The base fuel employed in the engine tests contained no fuel detergent. The test compounds were admixed with the base fuel at the indicated concentrations in Table III.

At the end of the test runs, intake valve deposit samples were rinsed with hexane, baked at 200° F. for 5 minutes, and then desiccated for one hour prior to weighing. Deposit material on the combustion chamber side of the valve was removed prior to weighing. The CLR engine has only one intake valve. The previously determined weight of the clean valve was subtracted from the weight of the valve at the end of the run. The difference between the two weights is the weight of the deposit. A lesser amount of deposit indicates a superior additive.

Combustion chamber deposit material was removed by scraping from the cylinder head and piston top region of the combustion chamber, and was not rinsed with any solvent prior to weighing. The total combustion chamber deposit weight value shown in Table III is the sum of the cylinder head region plus the piston top region. The results of the single cylinder engine test are set forth in Table III.

TABLE III

| Engine Test Results | | | |
|---|---|---|---|
| Sample | Additive Conc., ppma[1] | Total Intake Valve Deposits, mg. | Total Comb. Chamber Deposits, mg. |
| Base Fuel | — | 272 | 675 |
| Example 1 | 300 | 33 | 1104 |
| Example 1 | 2050 | 2.9 | 443 |
| Example 1 | 3000 | 6.8 | 299 |

[1]ppma = parts per million actives

The data in Table III demonstrates that the hydrocarbyl-substituted polyoxyalkylene amine additive employed at high concentrations (2,050 and 3,000 ppma) in accordance with the present invention provides a significant reduction in intake valve deposits, compared to both the base fuel and a lower concentration (300 ppma) of the additive.

The data in Table III further demonstrates that the use of 300 ppma of the polyoxyalkylene amine additive gives a substantial increase in combustion chamber deposits compared to the base fuel, whereas higher concentrations of the additive (2,050 and 3,000 ppma) provide an unexpected and dramatic decrease in combustion chamber deposits. This result is particularly surprising, since it would have been expected that such high concentrations of additive would actually contribute to combustion chamber deposits.

What is claimed is:

1. A fuel composition comprising a major amount of hydrocarbons boiling in the gasoline range and 2,050 to about 10,000 parts per million by weight of a compound of the formula:

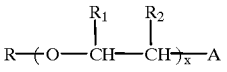

or a fuel-soluble salt thereof;

wherein R is a hydrocarbyl group having from about 1 to about 30 carbon atoms;

$R_1$ and $R_2$ are each independently hydrogen or lower alkyl having from about 1 to about 6 carbon atoms and each $R_1$ and $R_2$ is independently selected in each —O—$CHR_1$—$CHR_2$— unit;

A is amino, N-alkyl amino having about 1 to about 20 carbon atoms in the alkyl group, N,N-dialkyl amino having about 1 to about 20 carbon atoms in each alkyl group, or a polyamine moiety having about 2 to about 12 amine nitrogen atoms and about 2 to about 40 carbon atoms; and x is an integer from about 5 to about 100.

2. The fuel composition according to claim 1, wherein R is an alkyl or alkylphenyl group.

3. The fuel composition according to claim 1, wherein one of $R_1$ and $R_2$ is lower alkyl of 1 to 4 carbon atoms, and the other is hydrogen.

4. The fuel composition according to claim 3, wherein one of $R_1$ and $R_2$ is methyl or ethyl, and the other is hydrogen.

5. The fuel composition according to claim 1, wherein x is an integer of from about 5 to about 50.

6. The fuel composition according to claim 5, wherein x is an integer of from about 8 to about 30.

7. The fuel composition according to claim 6, wherein x is an integer of from about 10 to about 25.

8. The fuel composition according to claim 1, wherein A is amino, N-alkylamino or a polyamine moiety.

9. The fuel composition according to claim 8, wherein A is amino or N-alkyl amino having from about 1 to about 4 carbon atoms.

10. The fuel composition according to claim 9, wherein A is amino.

11. The fuel composition according to claim 8, wherein A is a polyamine moiety having from about 2 to about 12 amine nitrogen atoms and from about 2 to about 40 carbon atoms.

12. The fuel composition according to claim 11, wherein A is a polyamine moiety derived from a polyalkylene polyamine containing from about 2 to about 12 amine nitrogen atoms and from about 2 to about 24 carbon atoms.

13. The fuel composition according to claim 12, wherein the polyalkylene polyamine has the formula:

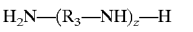

wherein $R_3$ is an alkylene group having from about 2 to about 6 carbon atoms and z is an integer from about 1 to about 4.

14. The fuel composition according to claim 13, wherein $R_3$ is an alkylene group having from about 2 to about 4 carbon atoms.

15. The fuel composition according to claim 13, wherein the polyalkylene polyamine is ethylene diamine or diethylene triamine.

16. The fuel composition according to claim 15, wherein the polyalkylene polyamine is ethylene diamine.

17. The fuel composition according to claim 1, wherein the composition contains from 2,050 to about 5,000 parts per million by weight of said compound.

18. The fuel composition according to claim 17, wherein the composition contains from 2,050 to about 4,000 parts per million by weight of said compound.

19. The fuel composition according to claim 18, wherein the fuel composition contains from about 2,600 to about 3,500 parts per million by weight of said compound.

20. The fuel composition according to claim 1, wherein the composition further contains from about 50 to about 5,000 parts per million by weight of a fuel-soluble, non-volatile carrier fluid.

21. A fuel composition comprising a major amount of hydrocarbons boiling in the gasoline range and about 2,600 to about 3,500 parts per million by weight of a compound of the formula:

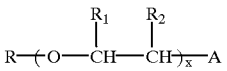

or a fuel-soluble salt thereof;

wherein R is a hydrocarbyl group having from about 1 to about 30 carbon atoms;

$R_1$ and $R_2$ are each independently hydrogen or lower alkyl having from about 1 to about 6 carbon atoms and each $R_1$ and $R_2$ is independently selected in each —O—$CHR_1$—$CHR_2$— unit;

A is amino, N-alkyl amino having about 1 to about 20 carbon atoms in the alkyl group, N,N-dialkyl amino having about 1 to about 20 carbon atoms in each alkyl group, or a polyamine moiety having about 2 to about 12 amine nitrogen atoms and about 2 to about 40 carbon atoms; and x is an integer from about 5 to about 100.

22. The fuel composition according to claim 21, wherein R is an alkyl or alkylphenyl group.

23. The fuel composition according to claim 21, wherein one of $R_1$ and $R_2$ is lower alkyl of 1 to 4 carbon atoms, and the other is hydrogen.

24. The fuel composition according to claim 23, wherein one of $R_1$ and $R_2$ is methyl or ethyl, and the other is hydrogen.

25. The fuel composition according to claim 21, wherein x is a n integer of from about 5 to about 50.

26. The fuel composition according to claim 25, wherein x is a n integer of from about 8 to about 30.

27. The fuel composition according to claim 26, wherein x is an integer of from about 10 to about 25.

28. The fuel composition according to claim 21, wherein A is amino, N-alkyl amino or a polyamine moiety.

29. The fuel composition according to claim 28, wherein A is amino or N-alkyl amino having from about 1 to about 4 carbon atoms.

30. The fuel composition according to claim 29, wherein A is amino.

31. The fuel composition according to claim 28, wherein A is a polyamine moiety having from about 2 to about 12 amine nitrogen atoms and from about 2 to about 40 carbon atoms.

32. The fuel composition according to claim 31, wherein A is a polyamine moiety derived from a polyalkylene polyamine containing from about 2 to about 12 amine nitrogen atoms and from about 2 to about 24 carbon atoms.

33. The fuel composition according to claim 32, wherein the polyalkylene polyamine has the formula:

$$H_2N—(R_3—NH)_z—H$$

wherein $R_3$ is an alkylene group having from about 2 to about 6 carbon atoms and z is an integer from about 1 to about 4.

34. The fuel composition according to claim 33, wherein $R_3$ is an alkylene group having from about 2 to about 4 carbon atoms.

35. The fuel composition according to claim 33, wherein the polyalkylene polyamine is ethylene diamine or diethylene triamine.

36. The fuel composition according to claim 35, wherein the polyalkylene polyamine is ethylene diamine.

37. The fuel composition according to claim 21, wherein the composition further contains from about 50 to about 5,000 parts per million by weight of a fuel-soluble, non-volatile carrier fluid.

* * * * *